US006131828A

United States Patent [19]

Buckley et al.

[11] Patent Number: 6,131,828

[45] Date of Patent: Oct. 17, 2000

[54] FUEL INJECTOR

[75] Inventors: Paul Buckley, Rainham; Malcolm David Dick Lambert, Bromley, both of United Kingdom

[73] Assignee: Lucas Industries Limited, London, United Kingdom

[21] Appl. No.: 09/332,272

[22] Filed: Jun. 11, 1999

[30] Foreign Application Priority Data

Jun. 26, 1998 [GB] United Kingdom ..... 9813743

[51] Int. Cl.[7] ..... F02M 59/00

[52] U.S. Cl. ..... 239/533.2; 239/452; 239/556

[58] Field of Search ..... 239/533.2–533.12, 239/452–456, 556

[56] References Cited

U.S. PATENT DOCUMENTS

| | | | |
|---|---|---|---|
| 2,035,203 | 3/1936 | Smith | 239/533.12 |
| 2,592,111 | 4/1952 | Bischof | 239/533.7 |
| 4,195,783 | 4/1980 | Hulsing | 239/533.3 |
| 4,339,080 | 7/1982 | Kopse | 239/533.3 |
| 5,405,088 | 4/1995 | Gordon et al. | 239/533.12 |
| 5,497,947 | 3/1996 | Potz et al. | 239/533.12 |
| 5,755,385 | 5/1998 | Potz et al. | 239/533.12 |

FOREIGN PATENT DOCUMENTS

| | | |
|---|---|---|
| 196 06 087 | 2/1996 | Germany . |
| 1 521 065 | 10/1975 | United Kingdom . |
| 2 296 041 | 6/1996 | United Kingdom . |
| 2 314 120 | 12/1997 | United Kingdom . |

*Primary Examiner*—Andres Kashnikow
*Assistant Examiner*—Dinh Q. Nguyen
*Attorney, Agent, or Firm*—Wells, St. John, Roberts, Gregory & Matkin, P.S.

[57] ABSTRACT

A fuel injector including a nozzle body having a bore defining a seating, a valve member having a plurality of passages providing fluid communication between the bore and a plurality of outlet openings, the outlet openings defining a first group of openings at a lower axial position on the valve member and a second group of openings at a higher axial position on the valve member. The valve member is slidable within the bore and is engageable with the seating to control fuel flow from the outlet openings. The outlet openings are shaped and orientated such that the sprays formed at the first and second groups of outlet openings do not interfere with one another.

9 Claims, 2 Drawing Sheets

FIG 4a
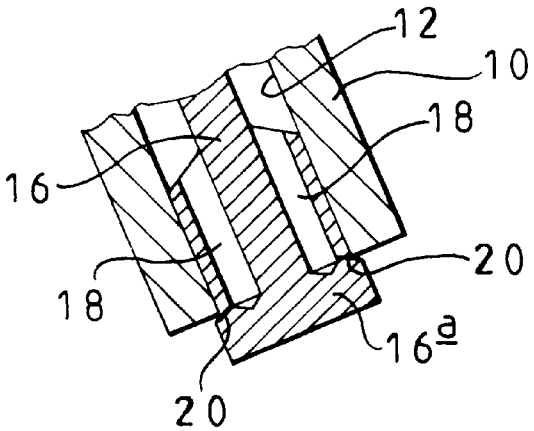
FIG 4b
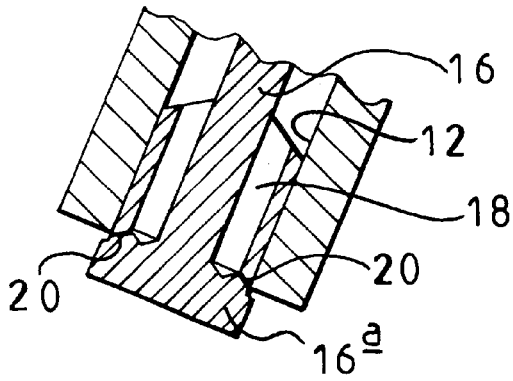
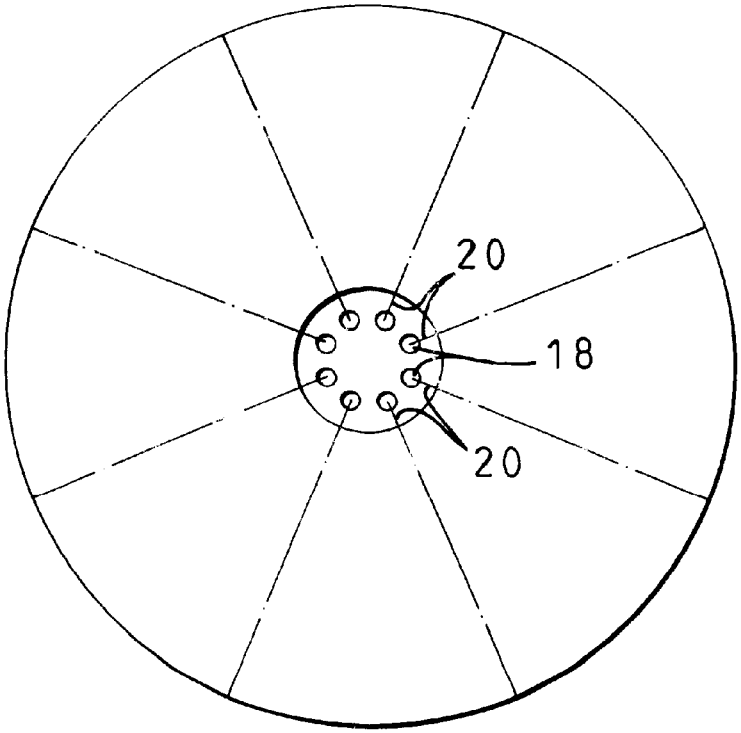
FIG 5

FUEL INJECTOR

This invention relates to a fuel injector for use in delivering fuel under pressure to a combustion space of a compression ignition internal combustion engine. In particular, the invention relates to a fuel injector of the outwardly opening type in which the total cross-sectional area of the openings through which fuel is delivered, in use, can be controlled.

FIG. 1 illustrates part of a known fuel injector which comprises a valve needle 1 slidable within a bore 2 formed in a nozzle body 3. The lower end of the bore 2 defines a seating with which an enlarged, lower part 1*a* of the needle 1 is engageable. Immediately above the part 1*a*, the needle 1 includes a region 1*b* of diameter substantially equal to the diameter of the bore 2 which forms a substantially fluid tight seal with the bore 2 and guides the needle 1 for sliding movement. Four equi-angularly spaced drillings 4 are provided in the region 1*b* of the needle 1, the drillings 4 each communicating with respective outlet openings 5*a* located immediately adjacent the upper surface of the part 1*a*, and openings 5*b* located above the openings 5*a* and separated by a thin wall.

In use, the needle 1 is spring biased towards a position in which the part 1*a* abuts the seating. When injection is to occur, fuel under pressure is supplied to the bore 2, applying a force to the needle 1 to urge the part 1*a* thereof in a downward direction in the orientation illustrated, urging the part 1*a* away from the seating against the action of the spring. Once movement of the needle 1 has commenced, fuel is delivered through the drillings 4 and the exposed parts of the openings 5*a*, 5*b*. The area of the openings 5*a*, 5*b* exposed by the movement of the needle 1 controls the rate of fuel injection. It has been found that the sprays formed at the openings 5*a*, 5*b*, in use, interfere with one another with the result that accurate spray targeting cannot be achieved. The part of the nozzle body 3 between the openings 5*a* and the openings 5*b* may become stressed to a high level, in use, thus increasing the risk of damage to the injector. Further, as the needle can be held stationary at positions in which the openings 5*a*, 5*b* are partially obscured by the nozzle body 3, the upper part of the spray may be deflected downwardly and interfere with the lower part of the spray.

According to the present invention there is provided a fuel injector of the type described hereinbefore, wherein the outlet openings define a first, lower group of openings and a second, higher group of openings, wherein the openings are shaped and orientated such that the sprays formed at the lower and upper groups of openings do not interfere with one another.

Each drilling may be associated with a single opening, or alternatively two or more of the openings may be associated with each drilling.

The invention will further be described, by way of example, with reference to the accompanying drawings, in which.

Figure 3:
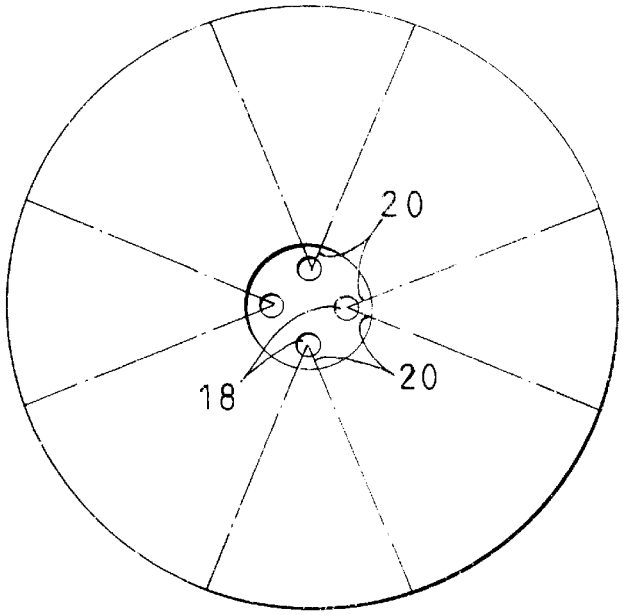
FIG. 3 is a diagram illustrating the orientation of the outlet openings in the arrangement of FIG. 2.

FIGS. 4*a* and 4*b* are views illustrating part of an alternative arrangement; and FIG. 5 is a view similar to FIG. 3 illustrating the positions of the openings of the injector of FIGS. 4*a* and 4*b*.

Figure 1:
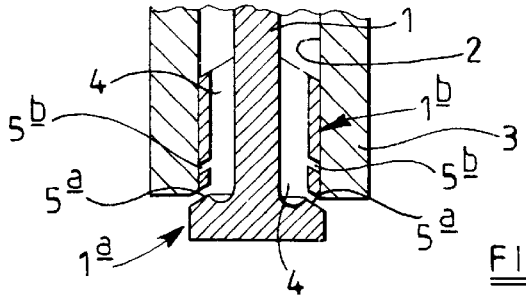
FIG. 1 is a view of part of a conventional injector.
Figure 2:
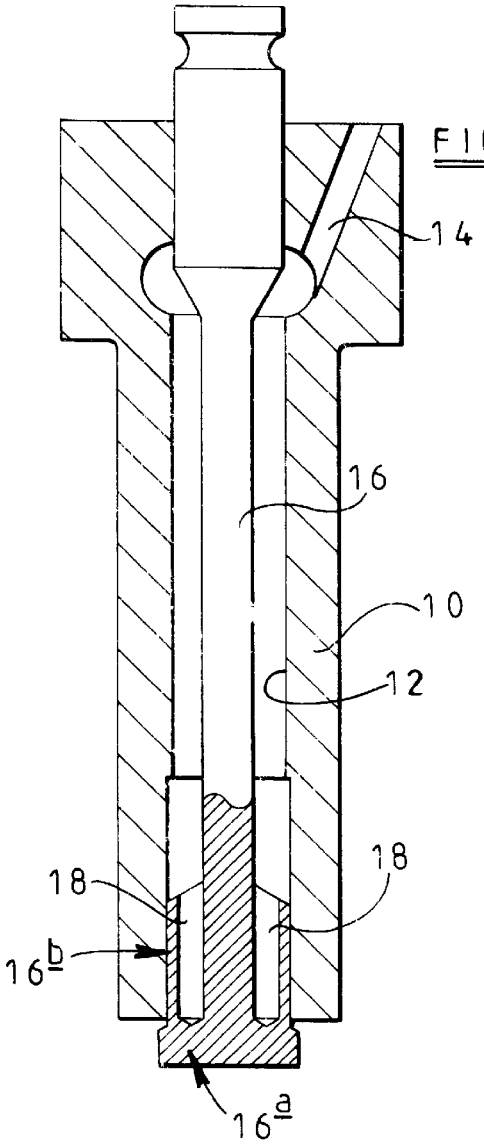
FIG. 2 is a sectional view of part of an injector in accordance with an embodiment.

FIG. 2 illustrates part of a fuel injector of the outwardly opening type, the fuel injector comprising a nozzle body 10 having a through bore 12 formed therein. The through bore 12 includes a region of enlarged diameter which communicates with a supply passage 14. In use, the supply passage 14 communicates with an appropriately controlled high pressure fuel source, for example in the form of a common rail charged to a high pressure by an appropriate fuel pump.

Slidable within the bore 12 is a needle 16, the upper end region of which is of diameter substantially equal to the diameter of the adjacent part of the bore 12 to guide the needle 16 for sliding movement within the bore 12. The lower end part 16*a* of the needle 16 is of enlarged diameter and is engageable with a seating defined around the lower end of the bore 12. Immediately upstream of the part 16*a* is a region 16*b* of diameter substantially equal to the diameter of the adjacent part of the bore 12. As illustrated in FIG. 2, the lower part of the bore 12 is of diameter slightly larger than that of the upper part of the bore 12. It will therefore be appreciated that the needle 16 is not pressure balanced, but rather, upon applying fuel under pressure to the bore 12, a force is applied to the needle 16 urging the needle 16 in a downward direction, thus urging the part 16*a* away from the seating. A spring (not shown) is provided to bias the valve needle 16 in an upward direction to urge the part 16*a* into engagement with the seating, and an appropriate control arrangement is provided to cause movement of the needle in a downward direction at appropriate times in the injection cycle.

The region 16*b* is provided with four equi-angularly spaced drillings 18 which extend in a direction parallel to the axis of the needle 16. Each drilling 18 communicates with a pair of outlet openings 20 (see FIG. 3) which are spaced apart from one another in the axial direction of the needle 16, and which are angularly spaced from one another as shown in FIG. 3.

FIG. 3 is somewhat diagrammatic in that it illustrates the angular position of both of the openings 20 which communicate with each drilling 18, even though the openings 20 are provided in different planes from one another as they are located in different axial positions.

In use, fuel under pressure is supplied to the bore 12. The needle 16 is urged to a position in which the part 16*a* engages the seating by the spring. The engagement between the part 16*a* and the seating ensures that fuel is not delivered to the combustion space with which the fuel injector is associated.

When injection is to take place, the control arrangement is actuated to cause downward movement of the needle 16, moving the part 16*a* of the needle 16 away from the seating. Shortly after the part 16*a* moves out of engagement with the seating, the lower group of outlet openings 20 defined by the lowermost outlet opening 20 communicating with each drilling 18 become uncovered by the nozzle body 10. These openings are shaped such that the sprays formed by the flow of fuel through the openings do not interfere with one another, this being achieved, in part, by ensuring that the area of each opening 20 is smaller than the areas of the openings in the conventional arrangement.

Depending upon the distance moved by the needle 16, the remaining, upper group of outlet openings 20 may also be uncovered, thus permitting delivery of fuel through all of the outlet openings 20. The upper group of outlet openings 20 are shaped to ensure that the sprays of fuel resulting from the flow of fuel through the upper group of outlet openings 20 do not interfere with one another, and also to ensure that the sprays formed at the upper group of outlet openings 20 do not interfere with the sprays formed at the lower group of outlet openings 20.

Conveniently, the upper group of outlet openings are arranged to deliver fuel in the form of a spray at a different cone angle to the sprays formed at the lower group of outlet openings.

The provision of a plurality of outlet openings communicating with each drilling 18 increases turbulence within the drillings 18 upstream of the outlet openings 20 which may result in improved atomization of fuel.

Although it is possible for the needle 16 to be held in an intermediate position in which some of the openings 20 are partly obscured, it is desirable to control the operation of the injector such that such conditions are avoided. However, the elimination of interference between sprays from the upper and lower groups of openings will mitigate the problems associated with unavoidable transient conditions.

Although in the description hereinbefore, the position of the needle 16 is controlled using an appropriate control arrangement, for example in conjunction with a mechanical or hydraulic tappet arrangement, via a servo-amplifier, or including an actuator which acts directly upon the valve needle, the injector may alternatively be used in an arrangement in which the needle position is controlled by controlling the fuel pressure applied to the injector.

FIGS. 4 and 5 illustrate an alternative embodiment, in which rather than arranging for a plurality of outlet openings to communicate with each drilling 18, the region 16*b* of the needle 16 is provided with eight equi-angularly spaced drillings 18, each drilling 18 being of reduced diameter, a respective one or the outlet openings 20 communicating with each drilling 18. The outlet openings 20 are arranged in two groups, the outlet openings 20 associated with alternate ones of the drillings 18 constituting a lower group which are positioned to communicate with the exterior of the needle 16 immediately adjacent the upper surface of the part 16*a* as illustrated in FIG. 4*a*, the outlet openings 20 associated with the remaining drillings 18 constituting an upper group which are arranged to communicate with the exterior of the needle 16 in a plane space above that at which the lower group of outlet openings 20 communicate with the exterior of the needle 16.

As with the embodiment illustrated in FIGS. 2 and 3, the upper group of outlet openings 20 are conveniently arranged to form sprays having a smaller cone angle than the sprays formed at the lower group of outlet openings 20. By providing an increased number of outlet openings 20 compared to the conventional arrangement, mixing is improved, interference between sprays is reduced or avoided, and targeting accuracy can be improved.

We claim:

1. A fuel injector comprising a nozzle body having a bore defining a seating, a valve member having a plurality of passages providing fluid communication between said bore and a plurality of outlet openings, said outlet openings defining a first group of openings at a lower axial position on said valve member and a second group of openings at a higher axial position on said valve member, said valve member being slidable within said bore and engageable with said seating to control fuel flow from said outlet openings, said outlet openings being shaped such that fuel flow from said outlet openings is in the form of a spray and wherein said outlet openings are shaped and orientated such that the sprays formed at said first and second groups of outlet openings do not interfere with one another.

2. The fuel injector as claimed in claim 1, wherein said outlet openings are shaped such that said spray of fuel from said first group of outlet openings has a different cone angle to said spray of fuel from said second group of outlet openings.

3. The fuel injector as claimed in claim 1, wherein said first group of outlet openings are angularly spaced from said second group of outlet openings.

4. The fuel injector as claimed in claim 1, wherein each of said passages provides fluid communication between said bore and two or more of said outlet openings.

5. The fuel injector as claimed in claim 1, wherein each of said passages provides fluid communication between said bore and a single outlet opening.

6. The fuel injector as claimed in claim 5, said passages being angularly spaced within said valve member, wherein said passages occupying alternate, angular positions provide fluid communication with said first group of outlet openings and wherein the other ones of said passages provide fluid communication with said second group of outlet openings.

7. The fuel injector as claimed in claim 1, wherein said valve member includes eight passages.

8. The fuel injector as claimed in claim 1, comprising more than eight outlet openings.

9. A fuel injector comprising a nozzle body having a bore defining a seating, a valve member having a plurality of passages providing fluid communication between said bore and a plurality of outlet openings, each of said passages providing fluid communication between said bore and a single outlet opening, said outlet openings defining a first group of openings at a lower axial position on said valve member and a second group of openings at a higher axial position on said valve member, said passages being angularly spaced within said valve member, wherein said passages occupying alternate, angular positions provide fluid communication with said first group of outlet openings and wherein the other ones of said passages provide fluid communication with said second group of outlet openings, said valve member being slidable within said bore and engageable with said seating to control fuel flow from said outlet openings, said outlet openings being shaped such that fuel flow from said outlet openings is in the form of a spray and wherein said outlet openings are shaped and orientated such that the sprays formed at said first and second groups of outlet openings do not interfere with one another.

* * * * *